US005727515A

United States Patent [19]

Biester

[11] Patent Number: 5,727,515

[45] Date of Patent: Mar. 17, 1998

[54] PROCESS AND DEVICE FOR CONTROLLING AN INTERNAL COMBUSTION ENGINE

[75] Inventor: Juergen Biester, Boeblingen, Germany

[73] Assignee: Robert Bosch GmbH, Stuttgart, Germany

[21] Appl. No.: 772,202

[22] Filed: Dec. 20, 1996

[30] Foreign Application Priority Data

Dec. 22, 1995 [DE] Germany ..... 195 48 280.8

[51] Int. Cl.[6] ..... F02M 37/04; F02B 77/00

[52] U.S. Cl. ..... 123/198 D; 123/458; 123/511

[58] Field of Search ..... 123/198 D, 198 DB, 123/457, 456, 497, 510–11

[56] References Cited

U.S. PATENT DOCUMENTS

| | | | |
|---|---|---|---|
| 4,807,583 | 2/1989 | Thornthwaite | 123/198 D |
| 4,811,711 | 3/1989 | Stumpp et al. | 123/198 D |
| 5,076,227 | 12/1991 | Krieger | 123/198 D |
| 5,275,207 | 1/1994 | Tonhauser et al. | 123/198 D |
| 5,295,470 | 3/1994 | Straubel | 123/198 D |
| 5,433,182 | 7/1995 | Augustin et al. | 123/198 D |
| 5,572,974 | 11/1996 | Wakeman | 123/198 D |

*Primary Examiner*—Thomas N. Moulis
*Attorney, Agent, or Firm*—Kenyon & Kenyon

[57] ABSTRACT

A method and a device for controlling an internal combustion engine having a high-pressure injection, and in particular, for controlling an internal combustion engine having a common rail system. The fuel is delivered by at least one pump from a low-pressure area into a high-pressure area. The fuel pressure prevailing in the high-pressure area is detected by a pressure sensor and is regulated by a pressure-regulation means. Given a defect in the area of the pressure regulation, the fuel pressure is controlled by influencing the flow of fuel in the low-pressure area.

12 Claims, 2 Drawing Sheets

PROCESS AND DEVICE FOR CONTROLLING AN INTERNAL COMBUSTION ENGINE

FIELD OF THE INVENTION

The present invention relates to a method and a device for controlling an internal combustion engine.

BACKGROUND INFORMATION

In motor vehicles having internal combustion engines, the fuel is delivered using an electric fuel pump from a fuel tank and supplied via fuel lines to injectors (injection valves). In internal combustion engines having high-pressure injection, and in particular, in self-ignition internal combustion engines, the electric fuel pump is coupled to another pump, producing a very high pressure in a high-pressure area of the fuel supply, which communicates with the injectors. Furthermore, a pressure-regulating valve is provided for in regulating the pressure in the high-pressure area. If this pressure-regulating valve is not functioning properly, the pressure prevailing in the high-pressure range can rise to unacceptable values.

SUMMARY OF THE INVENTION

With the method and the device for controlling an internal combustion engine, the object of the present invention is to make it possible for an emergency operation of an engine to be maintained, even when working with a defective pressure-regulating valve.

In the event that the pressure-regulating valve fails, the method and the device according to the present invention can ensure at least a limited operation without the occurrence of unacceptably high pressures.

DETAILED DESCRIPTION

Figure 1:
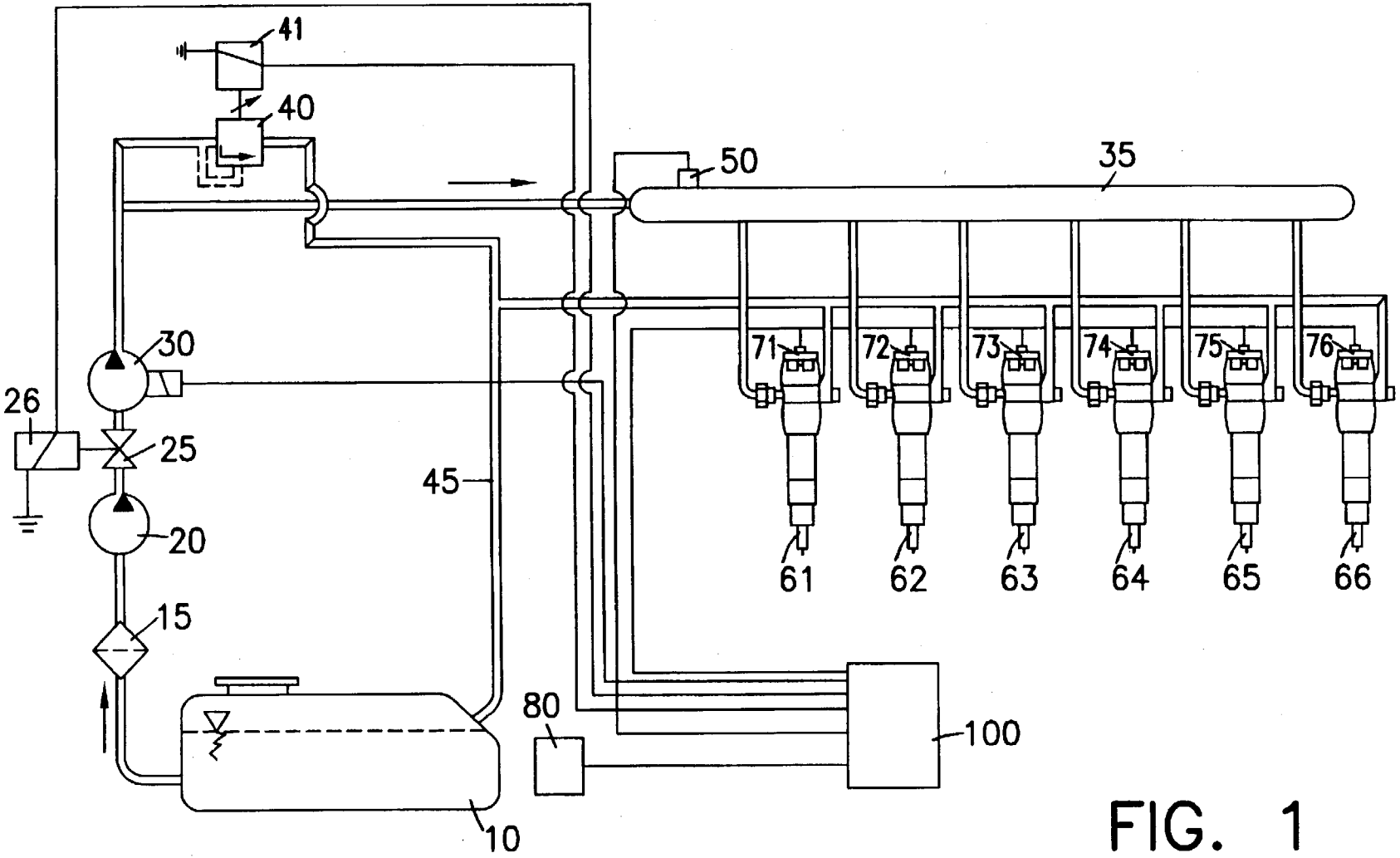
FIG. 1 shows a block diagram of the device according to the present invention.

FIG. 1 shows the components of a fuel-supply system of an internal combustion engine having high-pressure injection. The illustrated system can be described as a common rail system. A fuel-supply tank 10 communicates via a fuel-supply line having a filter 15, an auxiliary fuel-supply pump 20, a shutoff valve 25 and a high-pressure fuel-supply pump 30, with a rail 35.

A pressure-regulating valve 40 (e.g., a relief valve) is arranged in the fuel-supply line between the high-pressure fuel-supply pump 30 and rail 35. The supply line connected via this valve 40 to a return line 45. The pressure-regulating valve 40 joins the high-pressure area with a low-pressure area. The fuel returns via return line 45 to tank 10.

Shutoff valve 25 can be actuated using a coil 26. Valve 40 can be triggered by a coil 41. A sensor 50 is disposed on rail 35. This sensor 50 is preferably a pressure sensor, which avails a signal that corresponds to the fuel pressure prevailing in the rail and, thus, the pressure in the high-pressure area.

Rail 35 is connected via a line to individual injectors 61–66. The injectors 61–66 include solenoid valves 71–76, respectively, which enable the fuel flow through injectors 61–66 to be controlled. In addition, injectors 61–66 each communicate via one connection with return line 45.

The output signal of pressure sensor 50, as well as the output signals of other sensors 80 arrive at a control unit 100, which, in turn, controls solenoid valves 71–76, coil 26 of the auxiliary fuel-supply pump, coil 41 of pressure-regulating valve 40, and the high-pressure fuel-supply pump 30.

The operation of this device is as follows. Auxiliary fuel-supply pump 20 (which can be designed as an electric fuel-supply pump or as a mechanical pump) delivers the fuel contained in fuel-supply tank 10 via a filter 15 to high-pressure fuel-supply pump 30. High-pressure fuel-supply pump 30 delivers the fuel into rail 35 and builds up a pressure approximately between 100 and 2000 bar.

Arranged between high-pressure delivery pump 30 and auxiliary fuel-supply pump 20 is a shutoff valve 25, which can be driven by control unit 100 to interrupt the fuel flow.

On the basis of signals from various sensors 80, control unit 100 determines control signals to be received by solenoid valves 71–76 of the respective injectors 61–66. The start and the completion of the fuel injection into the internal combustion engine are controlled by the opening and closing of solenoid valves 71–76.

Pressure sensor 50 detects the pressure of the fuel prevailing in rail 35 and, thus, in the high-pressure area. On the basis of this pressure value, control unit 100 computes a signal to be received by pressure-regulating valve 40. Preferably by triggering the pressure-regulating valve 40, the pressure is adjusted to a specified value, which depends, among other things, on the operating conditions of the internal combustion engine which are detected by sensors 80.

If an error causes pressure-regulating valve 40 to remain in its closed or in a partially closed position, the pressure prevailing in the high-pressure area, and in particular in rail 35, rises substantially. At this point, the method and the device according to the present invention shuts off shut-off valve 25 and/or auxiliary fuel-supply pump 20, so that a simplified pressure regulation can be carried out by shut-off valve 25 and/or auxiliary fuel-supply pump 20.

Figure 2:
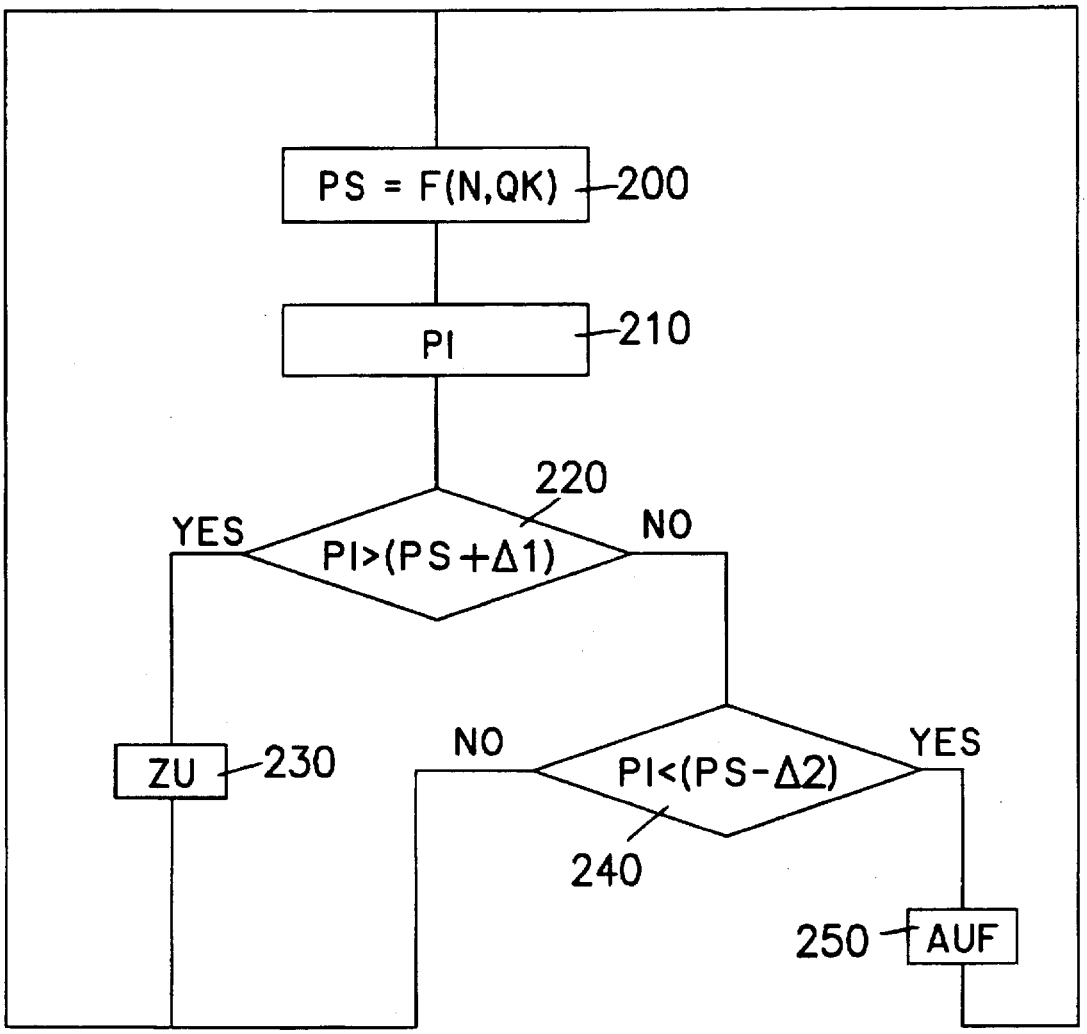
FIG. 2 shows a flow chart of the method according to the present invention.

FIG. 2 shows an embodiment of the method according to the present invention. In a first step 200, a setpoint value (a reference value) PS for the pressure prevailing in the rail is determined as a function F of the speed N and of the fuel quantity QK to be injected. In some instances, other variables can be retrieved to determine the setpoint value PS. In one of the embodiments according to the present invention, this value PS can be selected as a fixed value.

In a second step 210, actual value PI is determined by means of sensor 50. The subsequent query 220 checks whether the actual value PI is greater than an upper threshold value. This upper threshold value is generated by summing the expected value PS and a tolerance value $\Delta 1$. For the threshold value S1, the relation $S1=PS+\Delta 1$ applies. Thus, the actual pressure PI prevailing in the rail exceeds the maximum permissible rail pressure and, in step 230, the stopping device, this is, for example, the shutoff valve 25 or the auxiliary fuel-supply pump 20 is driven to prevent the flow of fuel.

If, on the other hand, query 220 recognizes that the value PI of the rail pressure is not greater than the maximum permissible rail pressure, then query 240 follows and checks whether the actual value is less than a lower threshold value S2. The lower threshold value results from the expected value PS and a tolerance value $\Delta 2$ as defined by the relation $S2=PS-\Delta 2$. If this is not the case, then the program continues with step 200. If it is the case, then the minimum permissible rail pressure is fallen short of and the stopping device is driven to enable the flow of fuel.

In the procedure described above, a simplified pressure regulation is realized, where the controller is designed as a two-step action controller. The method and the device according to the present invention can also check whether the pressure is greater than the maximum permissible value and, in such a case, a switch-off operation is carried out. If the pressure is less than the maximum permissible value, a switch-on operation is carried. In this embodiment according to the present invention, query 240 can be omitted.

If a regulation of the fuel pressure is provided, then both an unacceptably higher as well as an unacceptably lower pressure value can be compensated in the high-pressure area by initiating measures in the low-pressure area. This procedure ensures a limited pressure-regulation operation when working with a defective pressure-regulating valve 40.

What is claimed is:

1. A method for controlling an internal combustion engine having a high-pressure injection, comprising the steps of:

delivering a fuel using at least one pump from a low-pressure area to a high-pressure area;

detecting a fuel pressure existing in the high-pressure area with a pressure sensor;

adjusting the fuel pressure with a pressure-regulation device; and controlling a flow of the fuel in the low-pressure area for adjusting the fuel pressure when a defect is present in the pressure-regulation device in the high-pressure area.

2. The method according to claim 1, wherein the internal combustion engine includes a common rail system.

3. The method according to claim 1, wherein the flow of the fuel in the low-pressure area is interrupted when the pressure existing in the high-pressure area exceeds a first predetermined value.

4. The method according to claim 1, wherein the flow of the fuel in the low-pressure area is released when the pressure existing in the high-pressure area falls below a second predetermined value.

5. The method according to claim 3, wherein the flow of the fuel in the low-pressure area is released when the pressure existing in the high-pressure area falls below a second predetermined value.

6. The method according to claim 5, wherein the first and second predetermined values are determined as a function of at least one of a speed and an injected fuel quantity.

7. A device for controlling an internal combustion engine having a high-pressure injection, comprising:

at least one pump delivering a fuel from a low-pressure area to a high-pressure area;

a pressure sensor detecting a fuel pressure existing in the high-pressure area;

a first device regulating the fuel pressure; and a second device controlling a flow of the fuel in the low-pressure area to regulate the fuel pressure when a defect is present in the first device in the high-pressure area.

8. The device according to claim 7, wherein the internal combustion engine includes a common rail system.

9. The device according to claim 7, wherein the second device controls the flow of the fuel when the pressure existing in the high-pressure area exceeds a predetermined value.

10. The device according to claim 7, wherein the pressure is regulated in the high-pressure area by interrupting the flow of the fuel in the low-pressure area.

11. The device according to claim 7, wherein the second device includes at least one of a shut-off valve and an auxiliary fuel-supply pump.

12. The device according to claim 7, wherein the first and second devices include a two-step action controller.

* * * * *